United States Patent [19]

Titus

[11] 4,210,422

[45] Jul. 1, 1980

[54] REMOVAL OF SULFUR COMPOUNDS FROM COAL DURING PIPELINE TRANSPORT

[75] Inventor: Paul E. Titus, Houston, Tex.

[73] Assignee: Shell Oil Company, Houston, Tex.

[21] Appl. No.: 972,839

[22] Filed: Dec. 26, 1978

[51] Int. Cl.[2] ..... C10L 9/10; C10B 57/00

[52] U.S. Cl. ..... 44/15 R; 201/17

[58] Field of Search ..... 44/15 R, 51; 201/17

[56] References Cited

U.S. PATENT DOCUMENTS

| | | | |
|---|---|---|---|
| 2,346,151 | 4/1944 | Burk et al. | 44/51 X |
| 3,824,084 | 7/1974 | Dillon et al. | 201/17 X |
| 3,993,456 | 11/1976 | Cole et al. | 44/15 R |
| 4,054,420 | 10/1977 | Longanbach | 44/15 R |
| 4,055,400 | 10/1977 | Stambaugh et al. | 44/15 R |
| 4,080,176 | 3/1978 | Verschuur | 44/15 R |

*Primary Examiner*—Carl F. Dees

[57] ABSTRACT

Sulfur compounds are removed from coal during preparation of the coal for pipeline transport and during pipeline transport of the coal by preparing the coal in particles sufficiently fine for transport as an aqueous slurry, mixing the coal particles with oxygenated water and a basic chemical substance, transporting the coal as a slurry in a pipeline, separating the coal from water containing soluble sulfur compounds and from sludge-containing insoluble sulfur compounds.

5 Claims, No Drawings

REMOVAL OF SULFUR COMPOUNDS FROM COAL DURING PIPELINE TRANSPORT

BACKGROUND OF THE INVENTION

Coals contain sulfur compounds, both as inorganic materials such as pyrites, and as complex organic materials. During combustion of the coal, the sulfur is oxidized to sulfur oxide, noxious gasses that are highly corrosive to furnace equipment and which constitute health hazards in relatively small amounts. Because of the latter property, the emission of sulfur oxide is severely limited by environmental regulation. This limitation on the emission of sulfur oxides coupled with the expense and difficulty in scrubbing these materials from the combustion furnace stack gasses puts an economic premium on coals containing low sulfur levels.

Techniques are presently available for removing the inorganic fractions of the sulfur compounds from coal either by chemical reaction or by physical separation. Such processes frequently involve additional grinding of the coal to a fine particle size to make the pyrites more available and water washing to some degree. Either of these sulfur removal steps requires additional treatment to the coal beyond that which is usually used and thus adds to the overall cost.

Pertinent prior art includes a paper given at the American Chemical Society Symposium, August 29–31, 1972 in New York, New York: "Engineering, Economic and Pollution Control Assessment of Meyers' Process for Removal of Pyritic Sulfur from Coal", and the Bureau of Mines Report of Investigations 7633, "Sulfur Reduction Potential of Coals in the United States", A. W. Deuebrovck, Pittsburgh Energy Research Center. U.S. Pat. No. 2,128,913 discloses the mixing of air with a coal slurry prior to its introduction into a pipeline, and U.S. Pat. No. 2,346,151 discloses the addition of air to a coal slurry, in this case for the separation of undersized particles by flotation. Another patent of less pertinence is U.S. Pat. No. 3,768,988.

SUMMARY OF THE INVENTION

Generally, the process of the invention relates to the removal of sulfur compounds from coal during the preparation of the coal for pipeline transport and during pipeline transport of the coal and includes, but is not limited to, preparing the coal in particles sufficiently fine for transport as an aqueous slurry, mixing the coal particles with oxygenated water and a basic chemical substance, transporting the coal as a slurry in a pipeline, and separating the coal from the water containing soluble sulfur compounds and from sludge containing insoluble sulfur compounds.

More specifically, the process of the invention involves the following steps: First, coal from a conventional beneficiation plant is stored in such a manner that the material remains wet and in contact with either aerated water or air. The particle size of the coal is sufficiently small to permit ready reaction without presenting handling problems. Second, after a sufficient time has elapsed for an optimum portion of the inorganic sulfur compounds to react with the aerated water, the coal is delivered to a grinder, such as a ball or a rod mill, where it is wet-ground to a particle size distribution suitable for pipeline transport. At this time, more aerated water is added, along with suitable chemicals to neutralize acids formed by the reaction of the sulfur compounds and the oxygenated water. These chemicals include bases such as lime (calcium carbonate), soda ash (sodium carbonate) or caustic soda (sodium hydroxide), or other basic materials. Third, the slurry is delivered to a holding tank and then to a pipeline for transport. Additional chemicals can be added at the holding tank, at the inlet to the pipeline, or at subsequent locations along the pipeline if additional treatment is desirable. Fourth, at the terminus of the pipeline, the transported coal slurry is delivered to a settler followed by a dewatering step for the coal and a clarifying step for the water. Soluble sulfur compounds are removed with the water. Insoluble sulfur compounds, both reacted and unreacted, because of their relatively high density are removed from the coal as a sludge.

Preferred Embodiments

In accordance with the present invention, a process is provided wherein sulfur reduction is accomplished simultaneously with pipeline transport. The process involves chemical reactions wherein sulfur reduction is carried out in a more efficient manner since the reactions are optimized by the characteristics of pipeline slurry transport, namely finely divided coal in combination with relatively large amounts of water for extended periods of time. In addition, treatment of the coal at the pipeline terminus to remove water also permits removal of unwanted reaction products.

The inorganic sulfur compounds in coal are generally found as sulfides of iron and are dense, hard materials. These compounds react slowly in the presence of moisture and oxygen to form more highly oxidized forms of sulfur including sulfuric acid. Accordingly, the process of this invention relates to the removal of these materials in several ways, depending upon their chemical state, and includes first, reaction to sulfates and sulfuric acid, followed by neutralization and leaching with water and/or second, separation of insoluble reactants and unreacted sulfur compounds by gravity separation.

Coal useful in the present invention is prepared in a conventional beneficiation plant. Coal from the beneficiation plant is stored outside surrounded by drainage-trapping dikes, while spraying the coal with water so that the material remains wet and in contact with either aerated water or air, preferably both. The water may be recycled from the dikes and aerated in the process.

The particle size of the coal is sufficiently small to permit ready reaction without presenting handling problems. Thus, the particle size ranges from about 10 mm to about 30 mm. The coal particles are allowed to remain in this state from about 1 to about 7 days.

The above mentioned storage time of 1 to 7 days is generally sufficient for an optimum portion of the inorganic sulfur compounds to react with the aerated water, producing various acids of sulfur. The coal is then delivered to a grinder such as a rod mill, or a ball mill. The coal is there wet-ground to a particle size distribution suitable for pipeline transport.

TABLE I

PARTICLE SIZE DISTRIBUTION OF A TYPICAL COAL/WATER SLURRY

| U.S. Standard Sieve Series | Opening Microns | % w |
|---|---|---|
| +30 | 590 | 5 |
| −30, +50 | 297 | 20 |
| −50, +100 | 149 | 25 |
| −100, +200 | 74 | 15 |
| −200, +325 | 44 | 10 |

TABLE I-continued

| PARTICLE SIZE DISTRIBUTION OF A TYPICAL COAL/WATER SLURRY | | |
|---|---|---|
| U.S. Standard Sieve Series | Opening Microns | % w |
| −325 | — | 25 |

The percentage of water to solid particles typically ranges from 40% to 75% by volume. The percentage of water to coal of the above preferred particle size range extends from about 45% to 70% by volume.

Subsequent to the grinding step, more aerated water is preferably added to the coal particles. Generally, the total aerated water comprises from about 45% volume to about 70% volume of the slurry. Also, suitable chemicals are added to neutralize acids formed by the reaction of the sulfur compounds in the coal. These chemicals include commercially available bases such as lime (calcium carbonate), soda ash (sodium carbonate), or caustic soda (sodium hydroxide). Other chemicals, less preferred, may also be utilized such as ammonia, ammonium hydroxide, potassium carbonate, or potassium hydroxide.

Subsequently, slurry is delivered to a holding tank where it resides from about one-half day to about three days, during which further reaction occurs as more acids are produced and neutralized by the bases. Thereafter, the slurry is sent to a pipeline for transport. Additional chemicals can, of course, be added to the holding tank, at the inlet to the pipeline, and at subsequent locations along the pipeline if additional treatment becomes desirable. Generally, sufficient quantities of chemicals are added at these locations to neutralize any acid caused by the reaction of the pyrites and aerated water.

At the terminus of the pipeline, the transported coal slurry is delivered to a settler where the solids are removed from the liquid according to their respective densities. The coal can be further dewatered by centrifugation. The water from the settler is delivered to clarifier and a time of one to ten days is allowed for the water to clarify. Once clarification has occured, soluble sulfur compounds are removed with the water. Insoluble sulfur compounds both reacted and unreacted, because of ther relatively high density, are removed from the coal as a sludge. Insoluble compounds would include pyrites, sulfides and sulfates of calcium and unreacted calcium carbonate. Soluble materials would include sodium, potassium and ammonium salts.

Where it is not feasible to dispose of effluent water, it can be delivered to evaporation ponds and soluble salts collected and disposed.

I claim as an my invention:

1. A process for removal of sulfur compounds from coal during preparation of the coal for pipeline transport and pipeline transport of the coal, comprising:

storing the coal in contact with oxygenated water for 1 to 7 days;

preparing the coal in particles sufficiently fine for transport as an aqueous slurry;

mixing the coal particles with oxygenated water and a basic chemical substance selected from the group consisting of calcium carbonates, sodium hydroxide, ammonium hydroxide, ammonia, and sodium carbonate;

transporting the coal as a slurry in a pipeline; and separating the coal from water containing soluble sulfur compounds and from sludge-containing insoluble sulfur compounds.

2. The process of claim 1, wherein the coal is prepared for slurry pipeline transport by wet grinding .

3. The process of claim 2, wherein more oxygenated water is added after wet grinding the coal.

4. The process of claim 3, wherein said basic chemical substance is added along with said last added oxygenated water.

5. The process of claim 1, wherein the particle size range of coal particles in the slurry is from 0.004 mm to 5 mm.

* * * * *